US009644410B2

(12) United States Patent
Hayes et al.

(10) Patent No.: US 9,644,410 B2
(45) Date of Patent: May 9, 2017

(54) ADJUSTABLE HINGE ASSEMBLY

(71) Applicant: Delta Faucet Company, Indianapolis, IN (US)

(72) Inventors: Gerald R. Hayes, Lebanon, IN (US); Jeffrey D. Ferris, Carmel, IN (US); Jörg Krzewina, Westerstede Howiek (DE); Andree Buxnowitz, Emden (DE); Dieter zur Horst, Wiefelstede (DE)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 14/839,127

(22) Filed: Aug. 28, 2015

(65) Prior Publication Data

US 2017/0058584 A1 Mar. 2, 2017

(51) Int. Cl.

| | |
|---|---|
| ***E05D 7/06*** | (2006.01) |
| ***E05D 5/02*** | (2006.01) |
| ***E05D 3/02*** | (2006.01) |
| ***E06B 3/36*** | (2006.01) |

(52) U.S. Cl.

CPC ..... *E05D 5/0246* (2013.01); *E05D 3/02* (2013.01); *E06B 3/36* (2013.01); *E05D 2005/0253* (2013.01)

(58) Field of Classification Search

CPC ... E05D 5/0246; E05D 2005/106; E05D 3/02; E05D 2005/0253; E05D 7/0045; E05D 7/04; E05D 2005/0261; E05D 2005/0269; Y10T 16/532

See application file for complete search history.

(56) References Cited

U.S. PATENT DOCUMENTS

| | | | | |
|---|---|---|---|---|
| 2,248,372 | A * | 7/1941 | May | E05D 7/0054 16/240 |
| 5,499,428 | A * | 3/1996 | Okada | E05D 5/0246 16/221 |
| 7,617,567 | B2 * | 11/2009 | Franchini | E05D 7/04 16/236 |
| 7,748,081 | B2 * | 7/2010 | Ganter | E05D 7/04 16/235 |
| 8,944,394 | B2 * | 2/2015 | Berger | E05D 5/0246 16/215 |

(Continued)

*Primary Examiner* — Katherine Mitchell
*Assistant Examiner* — Abe Massad
(74) *Attorney, Agent, or Firm* — Faegre Baker Daniels LLP

(57) ABSTRACT

A shower door enclosure has fixed and pivotable hinge halves which can be preinstalled to fixed and pivotable panels, respectively. One or both of the hinge halves can be adjusted at the installation site without hinge disassembly. In particular, each hinge half may be mounted to its respective panel via a fastener passing through the panel and into a floating bushing. The floating bushing is received in a seat formed in the body of the hinge half. The bushing and seat are shaped to prevent continuous rotation of the bushing within the seat, allowing the fastener to be tightened against the panel without requiring external access to the bushing. Upon assembly of the door panel to the adjacent fixed panel via the respective hinge halves, the bushings may be allowed to "float" laterally and vertically within the hinge bodies while the panels are adjusted to a proper orientation, and the fasteners may then be tightened to fix the panels in place.

19 Claims, 12 Drawing Sheets

(56) References Cited

U.S. PATENT DOCUMENTS

2004/0050016 A1* 3/2004 Elmer ..... A47K 3/36
52/764
2004/0098831 A1* 5/2004 Elmer ..... E05D 15/0652
16/89

* cited by examiner

ADJUSTABLE HINGE ASSEMBLY

BACKGROUND

1. Technical Field

The present disclosure relates to door hinges, and, in particular, to pre-installed door hinges for shower door enclosures.

2. Description of the Related Art

Bathing enclosures are used to retain water flowing, e.g., from a shower head, within an enclosed area. For example, glass shower enclosures may include one or more glass panels and water resistant walls (e.g., the or fiberglass) and a shower head directed into the enclosure. A glass door may be pivotably attached to one of the glass panels, or to one of the walls, for ingress and egress by the user of the bathing enclosure.

Glass is a favored material for bathing enclosures owing to its ability to be cleaned repeatedly and thoroughly over a long service life, as well as its ability to admit light to the bathing enclosure. However, glass is also a relatively heavy and fragile material, particularly when used for large monolithic panels. In some instances, installation of glass bathing enclosures may be complicated by the competing needs of tight tolerances, e.g., for waterproofness at panel junctions, and adjustability among the various panels, e.g., to account for walls, floors, and or ceilings forming imperfect angles or other geometric relationships.

SUMMARY

The present disclosure provides a shower door enclosure with fixed and pivotable hinge halves which can be preinstalled to fixed and pivotable enclosure panels, respectively. One or both of the hinge halves can be adjusted at the installation site without hinge disassembly. In particular, each hinge half may be mounted to its respective panel via a fastener passing through the panel and into a floating bushing. The floating bushing is received in a seat formed in the body of the hinge half. The bushing and seat are shaped to prevent continuous rotation of the bushing within the seat, allowing the fastener to be tightened against the panel without requiring external access to the bushing. Upon assembly of the door panel to the adjacent fixed panel via the respective hinge halves, the bushings may be allowed to "float" laterally and vertically within the hinge bodies while the panels are adjusted to a proper orientation, and the fasteners may then be tightened to fix the panels in place.

In one form thereof, the present disclosure provides a hinge assembly comprising: a first hinge half fixable to a pivotable door and having a first hinge node; a second hinge half fixable to a stationary panel and having a second hinge node pivotably connectable to the first hinge node by a pivot pin; a recessed bushing seat formed in at least one of the first hinge half and the second hinge half, the bushing seat having a lateral extent and a vertical extent; and a floating bushing received in the bushing seat and sized to allow both lateral travel and vertical travel of the floating bushing within the bushing seat, while limiting rotation of the floating bushing within the bushing seat to a predetermined range.

In another form thereof, the present disclosure provides a shower door assembly comprising: a pivotable door; a stationary panel; a first hinge half fixed to the pivotable door and having a first pair of recessed bushing seats formed in a door-facing surface thereof; a second hinge half fixable to the stationary panel and having a second pair of recessed bushing seats formed in a door-facing surface thereof; and a floating bushing received in each of the recessed bushing seats and respectively captured between the pivotable door and first hinge half and the stationary panel and the second hinge half, each floating bushing sized to allow both lateral travel and vertical travel of each floating bushing within each respective bushing seat, each floating bushing sized to limit rotation of each floating bushing within each respective bushing seat to a predetermined range.

In yet another form thereof, the present disclosure provides a method of partially pre-assembling a shower enclosure, the method comprising: adjustably attaching a first hinge half to a pivotable door such that the first hinge half is moveable laterally and vertically, the first hinge half having a first hinge node defining a first longitudinal axis; and adjustably attaching a second hinge half to a stationary panel such that the second hinge half is moveable laterally and vertically, the second hinge half having a second hinge node defining a second longitudinal axis.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
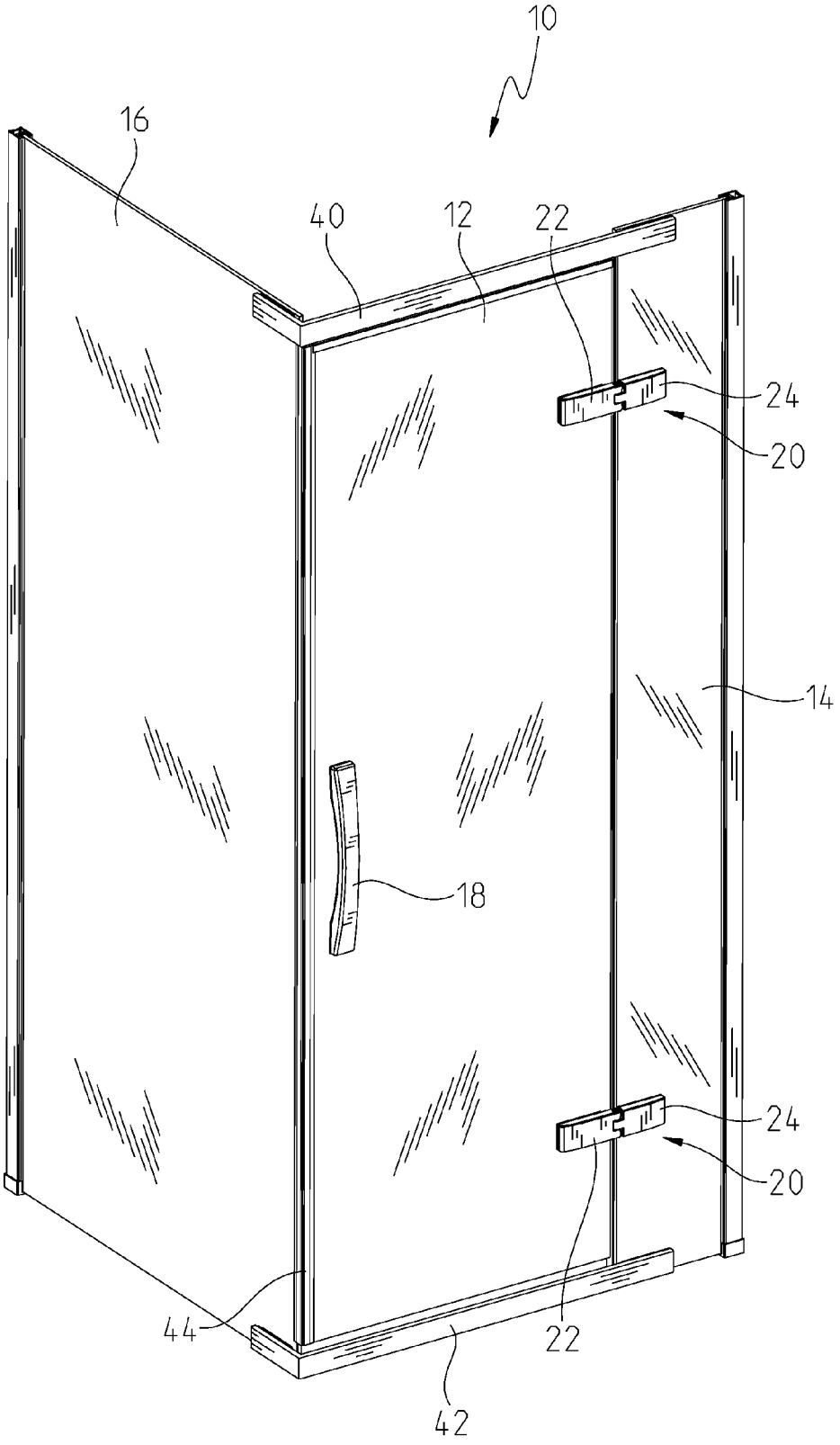
FIG. 1 is a perspective view of a shower enclosure made in accordance with the present disclosure.

FIG. 1 illustrates shower enclosure 10 including pivotable door 12 mounted to the adjacent stationary hinge panel 14 via a pair of hinge assemblies 20. As described in further detail below, each hinge assembly 20 includes a fixed hinge half 24 mounted to hinge panel 14, and a pivotable hinge half 22 mounted to door 12. Hinge halves 22, 24 may be independently mounted to the respective glass panels 12, 14 at the time of manufacture, rather than at the time of installation. The pre-assembled panels 12, 14 and hinge halves 22, 24 may then be delivered to a place of intended installation of shower enclosure 10, and adjusted as needed to provide proper alignment of door 12 and panel 14.

Figure 3:
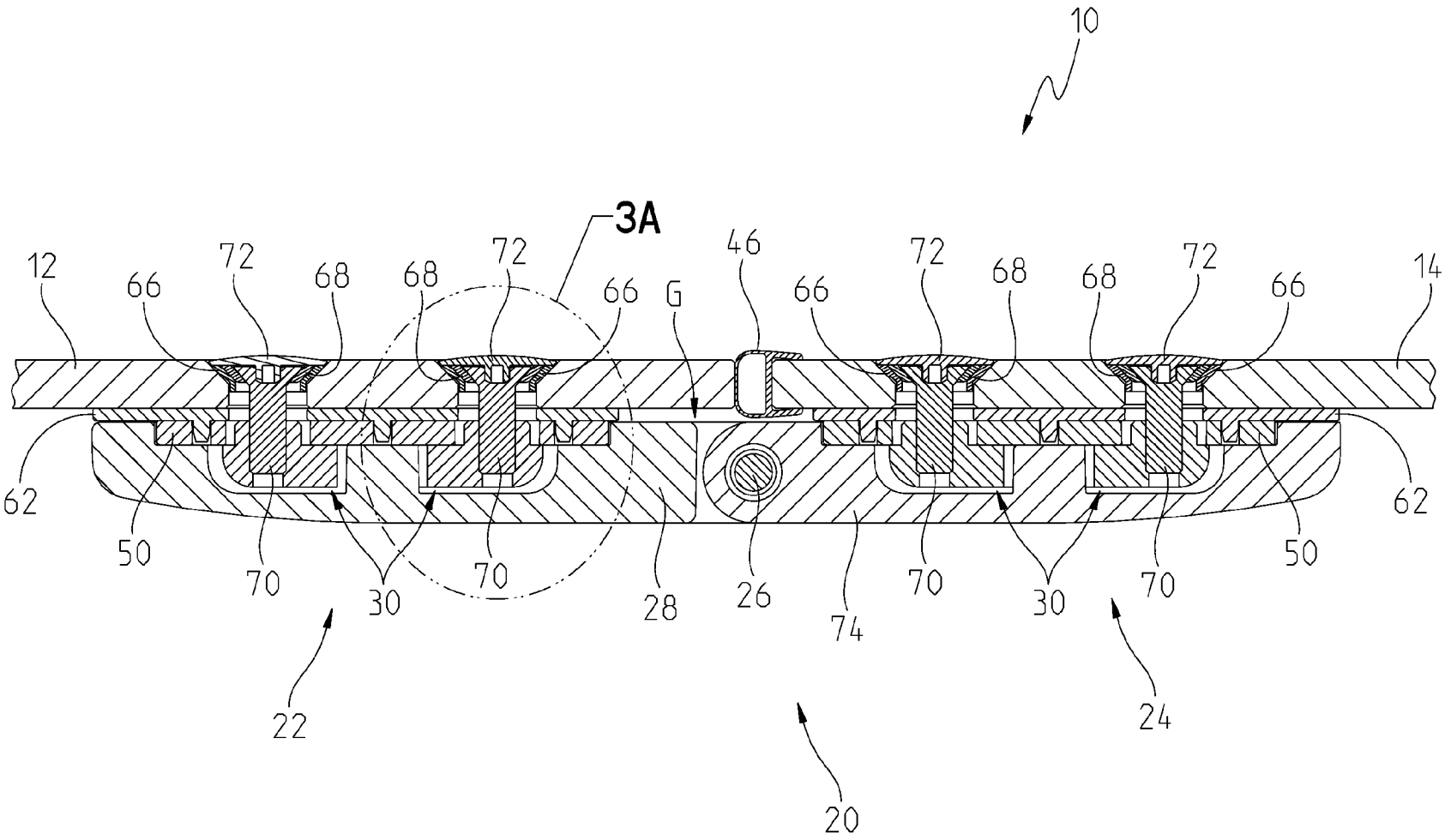
FIG. 3 is a plan, cross-section view of the hinge assembly shown in FIG. 2, taken along the line 3-3.

In the illustrative embodiment of FIG. 1, door 12 may define a relatively tight tolerance between header 40 and footer 42 of the door frame in the final installation. In addition, door 12 may define a precise fit with edge gasket 44 mounted along a vertical edge of latch panel 16. Yet another tight-tolerance fit may exist between door 12 and fixed panel 14, along edge gasket 46 (FIG. 3). The adjustability of hinge assembly 20 facilitates this close-tolerance fitting of door 12 to its surrounding structures, while maintaining a tight fit at the rotatable junction between hinge halves 22 and 24. In use, this arrangement allows door 12 to be opened and closed with a minimal effort of the user upon door handle 18, while also maintaining a tight, low-vibration, and generally high quality user feel and interface.

Although FIG. 1 illustrates a common shower enclosure configuration including door 12 and panel 14 which are substantially coplanar when door 12 is closed, as well as latch panel 16 forming a generally right angle with door 12 and hinge panel 14, it is contemplated that the methods and apparatuses of the present disclosure may be used in any desired enclosure arrangement, as required or desired for the needs of a particular user. In addition, other modifications may be made to the illustrated arrangement, such as the use of fewer or more numerous hinge assemblies 20 for door 12, the mounting of hinge assemblies inside or outside the shower enclosure, and the like.

Figure 2:
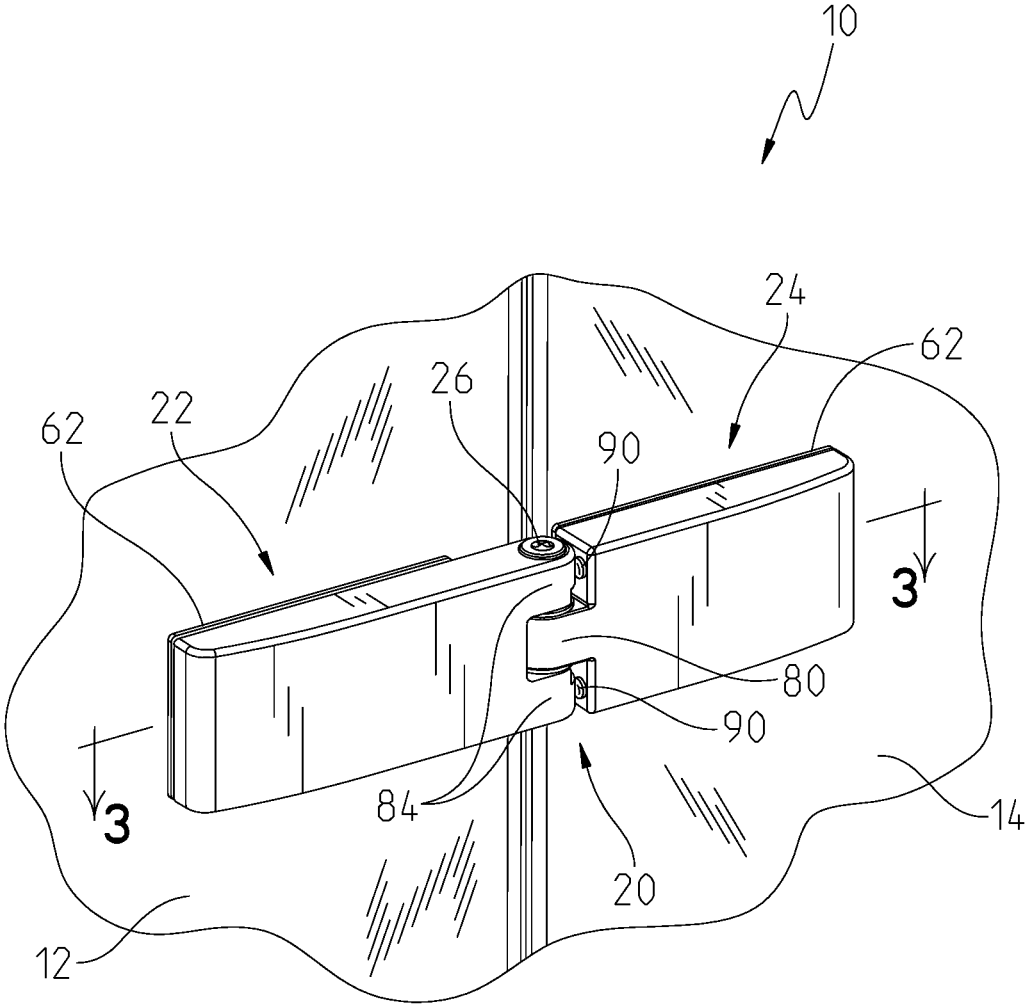
FIG. 2 is an enlarged perspective view of a hinge assembly shown in FIG. 1.

FIG. 2 illustrates an enlarged view of hinge assembly 20, including hinge halves 22, 24 pivotably linked to one another by hinge pin 26. As described in further detail below, pivotable hinge half 22 may be fixed to pivotable door 12 in a pre-assembly procedure remote from the intended installation of shower enclosure 10. Similarly, fixed hinge half 24 may be pre-assembled to hinge panel 14. When shower enclosure 10 is assembled at the site of intended use, hinge node 80 of hinge half 24 may be received between the corresponding hinge nodes 84 of hinge half 22 to align the longitudinal axes thereof, and hinge pin 26 may then be passed through nodes 80, 84 and secured (e.g., by threading into one of nodes 84) to pivotably connect door 12 to hinge panel 14. At this point, the position and alignment of door 12 may be adjusted relative to hinge panel 14 using the adjustability provided by one or both hinge halves 22, 24 in order to properly align and position door 12. Moreover, such adjustment is possible using hinge assembly 20 while also providing a tight-tolerance fit between hinge pin 26, hinge node 80, and hinge nodes 84, as further described below.

Figure 6:
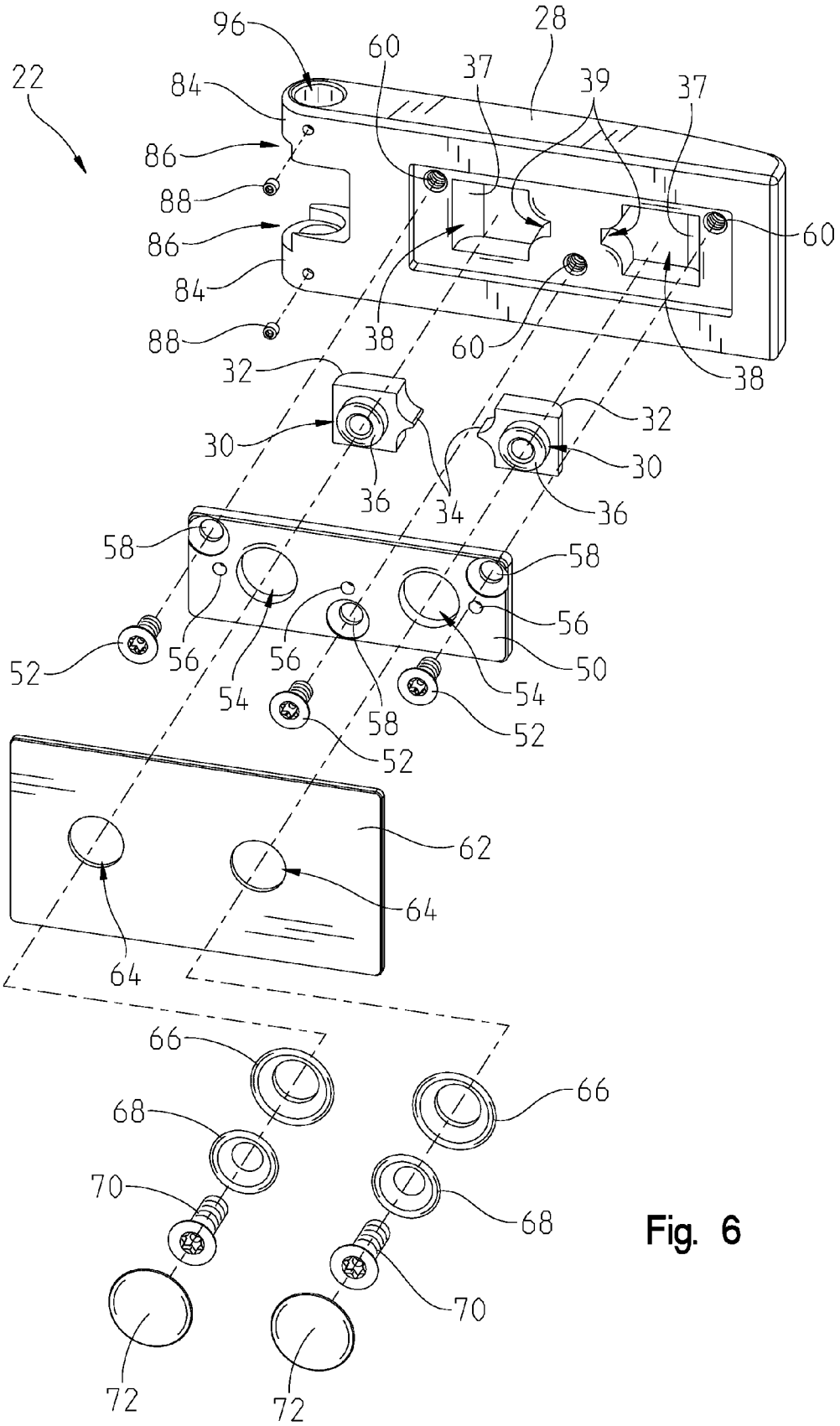
FIG. 6 is a perspective exploded view of a pivotable half of the hinge assembly shown in FIG. 2.

Turning to FIG. 6, the parts and assembly of pivotable hinge 22 are shown in detail. Pivotable hinge body 28 includes a pair of pockets or bushing seats 38 recessed into the otherwise planar door-facing surface of hinge body 28. Seats 38 are sized and configured to adjustably receive a corresponding pair of floating bushings 30. In particular, each floating bushing 30 includes a rounded edge 32 which can engage a correspondingly rounded edge 37 in bushing seat 38 when bushing 30 is moved to an extreme lateral adjustment point. Opposite rounded edge 32, floating bushing 30 includes pointed protrusion 34, formed by a pair of surfaces tapering towards a point as illustrated. Pointed protrusion 34 is loosely received within a correspondingly pointed recess 39 of seat 38, as illustrated.

Figure 7:
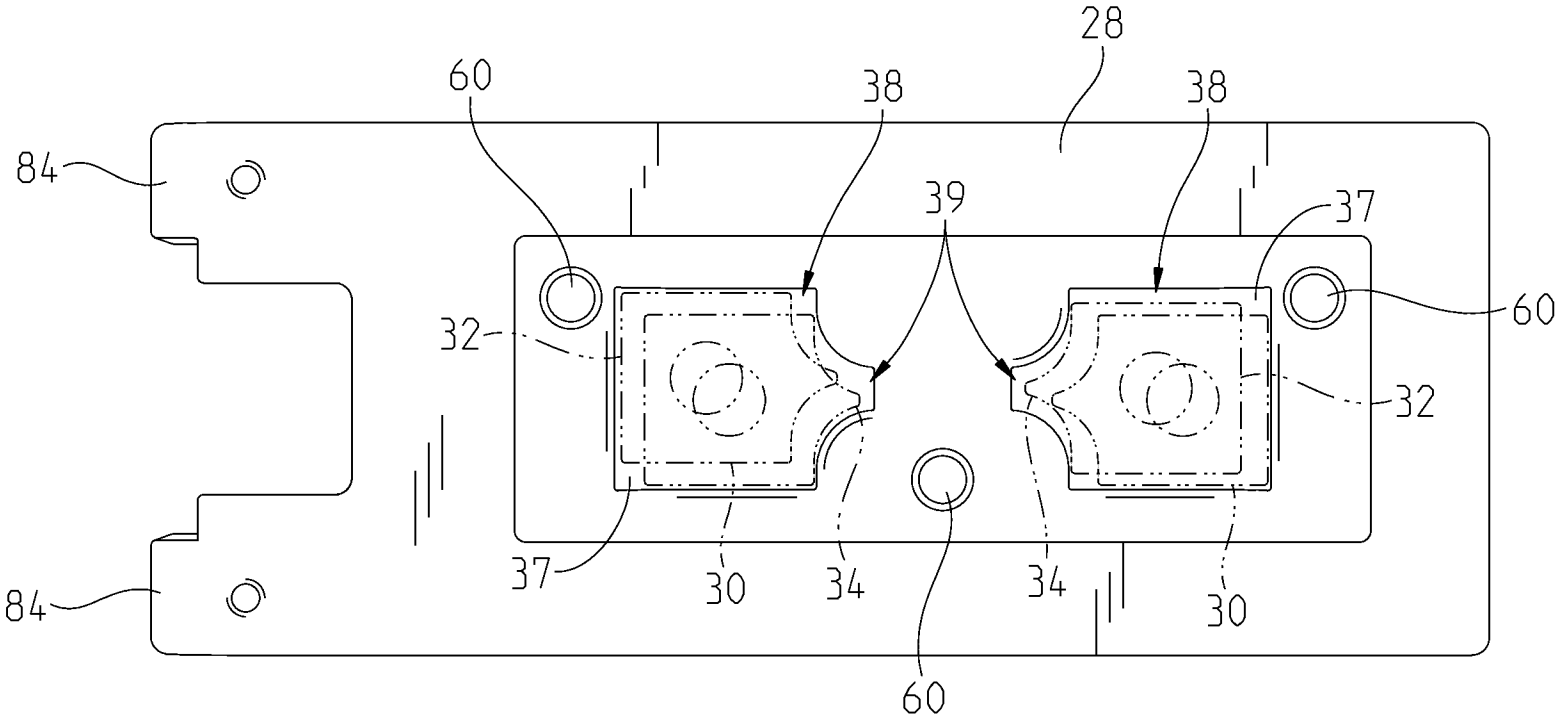
FIG. 7 is an elevation view of the pivotable hinge body of the pivotable hinge half shown in FIG. 6, illustrating lateral and vertical adjustability of floating bushings installed within the hinge half.

As best seen in FIG. 7, each bushing 30 can float or adjust both laterally and vertically within seats 38. For purposes of the present disclosure, "lateral" movement is considered to be side-to-side movement as shown in FIG. 7, and would typically correspond with a side-to-side movement of door 12 in its installed configuration as part of shower enclosure 10 (FIG. 1). Similarly, a "vertical" movement is an up-and-down movement as shown in FIG. 7. The nominal amount of lateral and vertical adjustment depends upon the overall lateral and vertical extent of seat 38 as compared to the lesser lateral and vertical extent of bushing 30, which in turn provides lateral and vertical clearance between bushing 30 and seat 38. In an exemplary embodiment, the total lateral clearance may be between 0.1 and 0.5 inches, and the total vertical clearance may be between 0.05 and 0.3 inches.

Figure 3A:
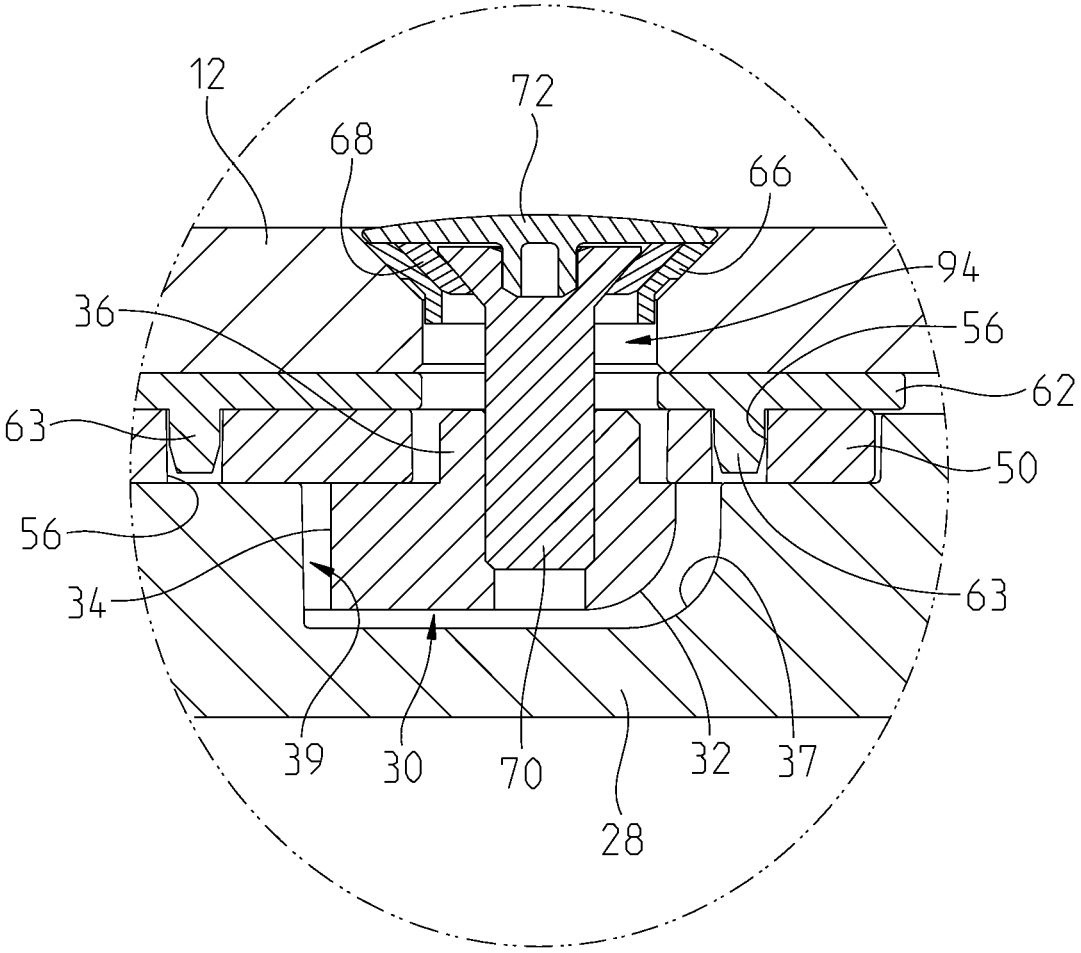
FIG. 3A is an enlarged view of a portion of the hinge assembly cross-section shown in FIG. 3, illustrating a connection between a portion of the hinge assembly and the adjacent enclosure panel.
Figure 7A:
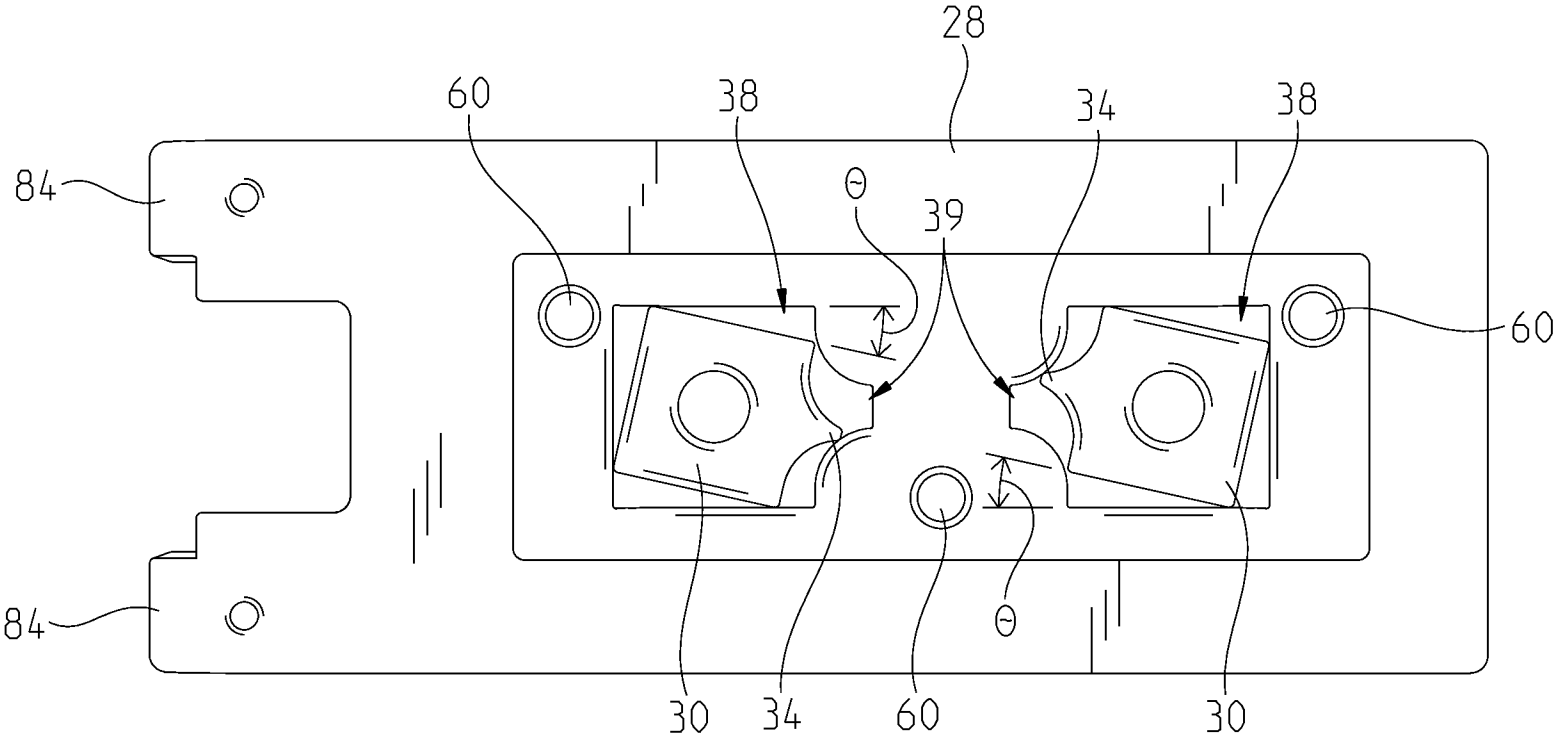
FIG. 7A is another elevation view of the hinge half shown in FIG. 7, illustrating rotational adjustability of the floating bushings.

Upon tightening fasteners 70 to fix hinge half 22 to door 12, as best shown in FIG. 3A and further described below, bushing 30 may be urged to rotate within seat 38 as torque is applied. Referring to FIG. 7A, the amount of rotation of each floating bushing 30 within seat 38 is limited to a predetermined angular range Θ in either direction (clockwise or counterclockwise). In particular, pointed protrusion 34 abuts the wall of pointed recess 39 at limits of the predetermined range Θ, as shown by a comparison of the left and right bushings 30 in FIG. 7A, which are respectively illustrated at clockwise and counterclockwise limits of rotation. In this way, protrusions 34 cooperate with recesses 39 in order to prevent free rotation of bushings 30 within seats 38 regardless of the lateral and vertical position of bushings 30 within respective seats 38.

In particular, the tapered walls of pointed protrusion 34 define convex tapering surfaces having a radius and extent approximately equal to the corresponding concave surfaces of the walls defining pointed recess 39, as illustrated. This convex/concave surface arrangement ensures that floating bushings 30 may move throughout their intended ranges of lateral and vertical motion, while also ensuring that bushings 30 cannot freely rotate within seat 38. In an exemplary embodiment, the predetermined angular range Θ may be as little as 5 degrees, and as much as 20 degrees in either direction. In the illustrated embodiment, angular range Θ is nominally between 5 degrees and 6 degrees, and expands to between 5 and 10 degrees depending on the vertical and lateral position of bushing 30 relative to the adjacent sidewalls of pocket 38.

Referring again to FIG. 6, retainer plate 50 may be provided to capture bushings 30 within their respective seats 38. In the illustrated embodiment, hinge body 28 includes a recess sized to receive plate 50 such that, when plate 50 is installed to body 28, a flush door-facing surface is formed by both hinge body 28 and plate 50. As shown in FIG. 3A, bushing 30 may include threaded barrel 36 which protrudes into respective barrel apertures 54 formed in plate 50 when bushing 30 is received in seat 38. Apertures 54 are oversized relative to the outer diameter of barrels 36, such that apertures 54 do not limit the vertical or lateral travel of barrels 36 as bushings 30 laterally or vertically adjust. Plate 50 may further include retainer bores 58 which allow retainer screws 52 be received within threaded bores 60 to fix retainer plate 50 to body 28. In the illustrated embodiment, bores 58 are countersunk and receive screws 52 with correspondingly conical heads to avoid disruption of the generally planar door-facing surface of hinge body 28 and plate 50.

Pressure plate 62 is mounted to the door-facing surface of hinge body 28 and plate 50, as best shown in FIG. 3. In particular, locating protrusions 63 (FIGS. 3A and 3B) may be received within corresponding locating apertures 56 of plate 50 (FIG. 6). Pressure plate 62 further includes a pair of mounting apertures 64 which align with apertures 54 and allow access to each threaded barrel 36 of floating bushings 30.

Upon assembly, hinge body 28 with pressure plate 62 may be abutted to the mounting surface of door 12, as shown in FIG. 3, such that hinge-fixation apertures 94 (FIG. 3B) formed in the glass panel of door 12 align with apertures 64, 54 of hinge half 22. In an exemplary embodiment, pressure plate 62 is formed of a polymer material, such as polysulfone, nylon, various thermoplastic elastomers, polyvinyl chloride (PVC), and other materials suitable to prevent direct contact between metal components of hinge assembly 20 and the glass of panels 12, 14. In particular, the material of pressure plate 62 may be chosen to slightly deform and/or compress under pressure against the surface of door 12, in order to provide a consistent and distributed pressure between the door facing surfaces of hinge body 28 and retainer plate 50 on one side and the surface of door 12 on the opposite side.

Figure 3B:
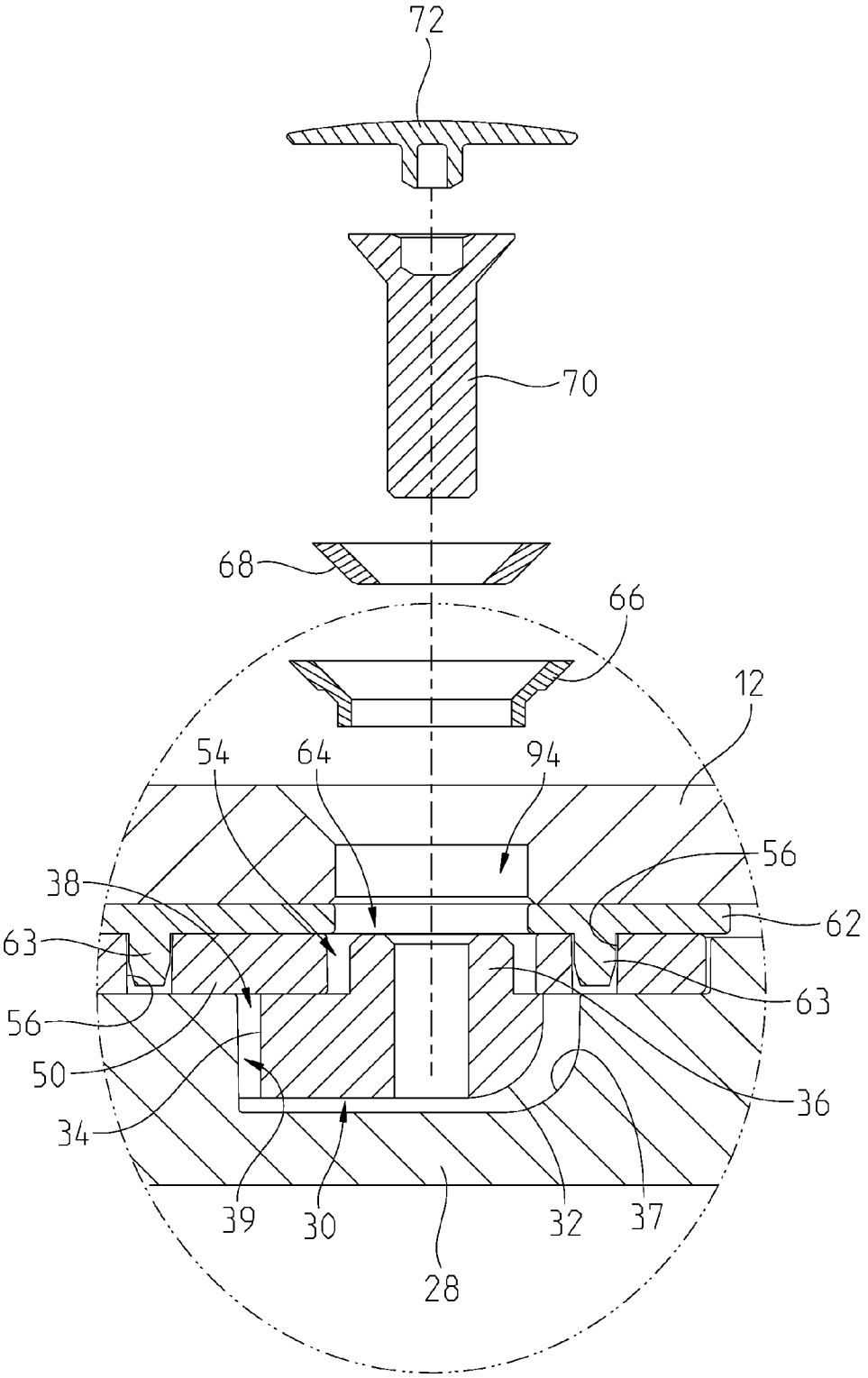
FIG. 3B is a partially exploded view of the connection shown in FIG. 3A.

At the inner surface of door 12, an arrangement of fasteners and bushings may be used to fix hinge half 22 to door 12, as shown in FIGS. 3, 3A, and 3B. First, flexible bushing 66 is received within each fixation aperture 94 of door 12. As best seen in FIG. 3B, deformable bushing 66 includes a generally cylindrical portion received within a correspondingly cylindrical portion of bore 94, and a frusto-conical portion received within the countersink of bore 94. Deformable bushing 66 is made from a relatively soft and flexible material such as, for example, a relatively flexible polymer. In an exemplary embodiment, the material of bushing 66 may be polysulfone, nylon, acrylonitrile butadiene styrene (ABS) plastics, polypropylene and other polymer materials which are resistant to fracture due to hoop stresses. Next, bushing 68 made of a more rigid material than the deformable bushing 66 (i.e., a material having a higher elastic modulus) is received within and seated against the frusto-conical portion of bushing 66. In an exemplary embodiment, rigid bushing 68 may be made of steel, aluminum or other another metal, or from a more rigid polymer material. Finally, fastener 70 is passed through bushings 68, 66, and hinge-fixation aperture 94, reaching the outer side of door 12. Fastener 70 continues through aperture 64 of pressure plate 62 and engages threaded barrel 36 of bushing 30. Bolt 70 may then be rotated to tighten hinge half 22 against door 12.

As bolt 70 is tightened, rigid bushing 68 centers within flexible bushing 66, and may slightly compress and/or deform flexible bushing 66 to evenly distribute pressure around the countersunk portion of hinge-fixation aperture 94 and door 12. At the same time, pressure plate 62 provides distributed pressure from bushing 30 via retainer plate 50 and the door facing surface of hinge body 28, as noted above. In addition, it can be seen from FIGS. 3A and 3B that apertures 94, 64, and 54 all provide ample clearance for bolt 70 and threaded barrel 36, with the clearance being sized such that bushing 30 may move through its full range of lateral and vertical adjustment (as described in detail above) without risking direct contact between bolt 70 and the glass material of door panel 12. In addition, the compressibility and/or deformability of bushing 66 allows the longitudinal axis of bolt 70 to be askew from the longitudinal axis of hinge-fixation aperture 94 upon final installation, while avoiding a high concentration of pressure in the material of door 12. Thus, the relatively brittle material of door 12 is protected from excess pressure by the arrangement of hinge half 22 and its method of attachment.

Bolt head cover 72 may be installed as a final step in order to protect the head of bolt 70 and the material of bushing 68 from the shower enclosure environment. Notably, as shown in FIG. 3A, the periphery of bolt head cover 72 is slightly recessed into the countersunk portion of door 12, thereby avoiding the periphery of bolt head cover 72 from sitting proud of the adjacent surface of door 12. This arrangement facilitates easy and thorough cleaning over the a long product service life.

Figure 5:
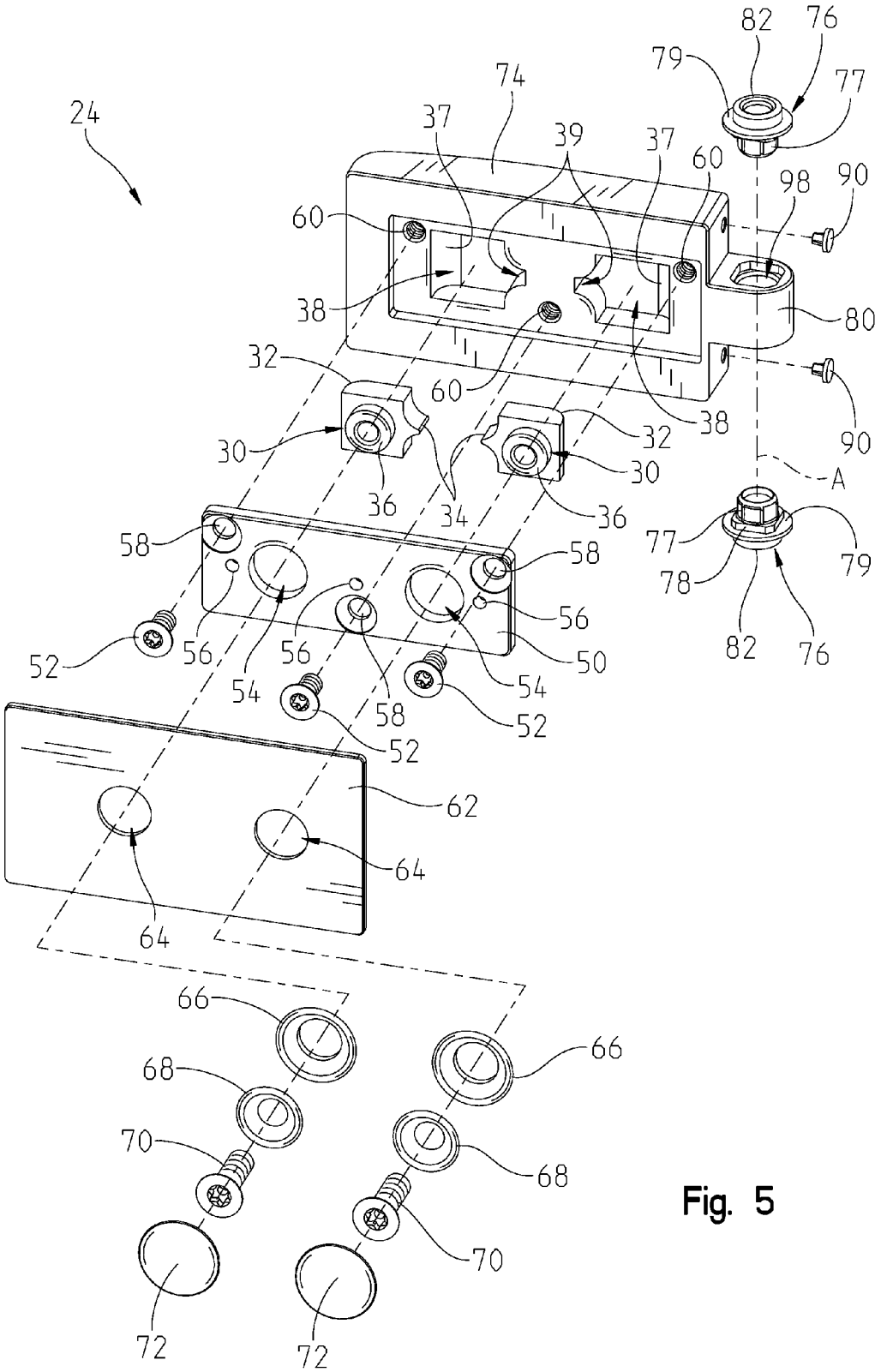
FIG. 5 is a perspective exploded view of a fixed half of the hinge assembly shown in FIG. 2.

Turning now to FIG. 5, fixed hinge half 24 is shown in a similar fashion to pivotable hinge half 22 of FIG. 6. Moreover, bushings 30, retainer plate 50, pressure plate 62, bushings 66, 68, and fastener 70 may be used to assemble hinge half 24, and to adjustably connect hinge half 24 to hinge panel 14 in the same manner as hinge half 22 and door 12 described above.

However, fixed hinge half 24 includes a single hinge node 80 with hinge bearings 76 assembled thereto, while hinge half 22 includes a pair of hinge nodes 84 each having bearing channel 86 which receives hinge node 80 and bearings 76, as described in further detail below. Although the illustrated embodiment utilizes a single node 80 on fixed hinge half 24 and a pair of nodes 84 on pivotable hinge half 22, it is contemplated that any number of alternating hinge nodes may be used as required or desired for a particular application. Moreover, it is also contemplated that bearings may be mounted to fixed hinge half 24 or pivotable hinge half 22 in any combination.

As best seen in FIG. 5, each bearing 76 includes inner boss 77 and outer boss 82 separated by flange 79. A non-round shoulder 78 is disposed between inner boss 77 and flange 79. Bearings 76 are assembled to each opposing axial end of hinge node 80, such that inner boss 77 is received into hinge bore 98 and non-round shoulder 78 engages a correspondingly non-round portion of bore 98 to prevent rotation of bearings 76 relative to hinge body 74 after installation of bearings 76 and during use of hinge assembly 20.

Turning again to FIG. 4, bearings 76 are shown assembled to hinge node 80, with flanges 79 fully seated against the upper and lower axial surfaces of node 80. When door 12 is assembled to hinge panel 14, outer bosses 82 are snugly received into channels 86 of hinge nodes 84. In an exemplary embodiment, the nominal clearance between the outer diameter of outer bosses 82 and the corresponding inner diameter defined by channels 86 is between 0.000 inches and 0.020 inches. That is, outer bosses 82 define a nominal 0.010-inch clearance fit with channels 86, and may deviate between a zero-clearance fit and a 0.020-inch clearance fit. When door 12 is opened, the lack of significant clearance between bosses 82 and channels 86 provides for a smooth, tight and low-vibration hinge action that promotes quiet operation and an overall high-quality feel. Given that installation sites can be expected to vary in quality of fit and finish, this tight clearance is facilitated by the adjustable mounting of hinge halves 22 and 24 to the respective door panels 12 and 14, which can correct for irregular mounting surfaces without further adjustment being necessary at the pivotable hinge connection itself.

The clearance along the axial direction between the terminal axial ends of outer bosses 82 and the axial inner ends of hinge nodes 84 may provide a modest amount of clearance, i.e., as little as 0.025 inches clearance and up to 0.065 inches clearance. This clearance facilitates installation of door 12 to panel 14 with hinge halves 22, 24 pre-installed, as described further below. When assembled, the weight of door 12 tends to pull hinge node 80 into firm contact with the lower hinge node 84, such that the clearance forms a slight gap between hinge node 80 and the upper hinge node 84.

Once hinge nodes 80, 84 are assembled and aligned, hinge pin 26 may be passed through hinge bores 96 of hinge nodes 84, as well as through hinge bore 98 and bearings 76 to rotatably couple door 12 to fixed hinge panel 14. In an exemplary embodiment, are portion of bore 96 is threaded at both hinge nodes 84. This threaded portion threadably receives hinge pin 26 at both of nodes 84, such that hinge pin 26 may be installed from either direction depending on the configuration of hinge assembly 20 at the site installation. This allows hinge pin 26 to always be installed with head 27 at the top of hinge assembly 20, such that hinge pin 26 is prevented from falling away from hinge assembly 20 even if pin 26 comes loose. Head 27 of pin 26 may be received in a counterbore portion of the upper hinge node 84, while a threaded cover 92 may be provided at the corresponding counterbore of the lower hinge node 84 in order to provide a finished look and prevent material from entering bore 96 from below. In an exemplary embodiment, a chamfered (i.e., frusto-conical) surface may be formed adjacent the hex-shaped drive aperture through cover 92. When cover 92 is received in bore 96, this frustoconical surface may engage a correspondingly chamfered surface at the distal end of pin 26 such that cover 92 centers pin 26 and provides a bearing surface therefor.

Optionally, set screws 88 (FIG. 4) may pass transversely, i.e., along a radial direction with respect to axis A, into each of hinge nodes 84 in order to engage either head 27 of hinge pin 26 or pin cover 92 after installation. This set screw engagement may provide further assurance against loosening of cover 92 or hinge pin 26 over the long service life that may be expected for shower enclosure 10.

Turning again to FIG. 5, door stops 90 may be provided in body 74 of hinge half 24 as illustrated. Stops 90 are spaced radially outwardly from longitudinal axis A of hinge node 80, and are positioned to receive contact by pivotable hinge body 28 when door 12 reaches a fully opened position. Stops 90 may be made of a relatively soft polymer or rubber material in order to cushion such contact and thereby soften a forcible opening of door 12. In an exemplary embodiment, door stops 90 may be spring loaded to provide further deceleration potential. In an exemplary embodiment, hinge halves 22, 24 are designed to accommodate between 90 degrees and 135 degrees of total pivotable motion of door 12 with respect to hinge panel 14 before door stops 90 are engaged.

After proper installation and adjustment of door 12 relative to fixed panel 14, as described herein, gasket 46 mounted to hinge panel 14 experiences substantially constant and even compression along its vertical extent, which may extent along the entire vertical edge of door 12 and panel 14. Gap G (FIG. 3) is provided between hinge bodies 28, 74, and the adjacent surfaces of panels 12, 14 to provide clearance for gasket 46. In order to provide a desired nominal value for gap G, the thickness of pressure plate 62 may be increased or decreased as needed. Similar proper compression of gaskets provided at header 40, footer 42, and/or edge gasket 44 (FIG. 1) may also be ensured by proper alignment procured by adjustment of hinge halves 22 and 24.

In an exemplary production method, hinge halves 22, 24 are installed to pivotable door 12 and hinge panel 14 respectively prior to shipping the components of shower enclosure 10 to an end user, installer or other intermediary. In the initial adjustment, hinge bodies 28, 74 may be generally centered over hinge fixation apertures 94, such that panel mounting bolt 70 is generally coaxial with hinge fixation aperture 94 and floating bushing 30 is generally centered in bushing seat 38. However, it is noted that manufacturing tolerances, such as those specified for hinge-fixation apertures 94, need not be controlled within an extremely tight tolerance because substantial adjustability is designed into hinge assembly 20. Hinge halves 22, 24 may be tightened onto door 12 and panel 14 prior to shipping, or may be left secured but slightly loose.

Figure 4:
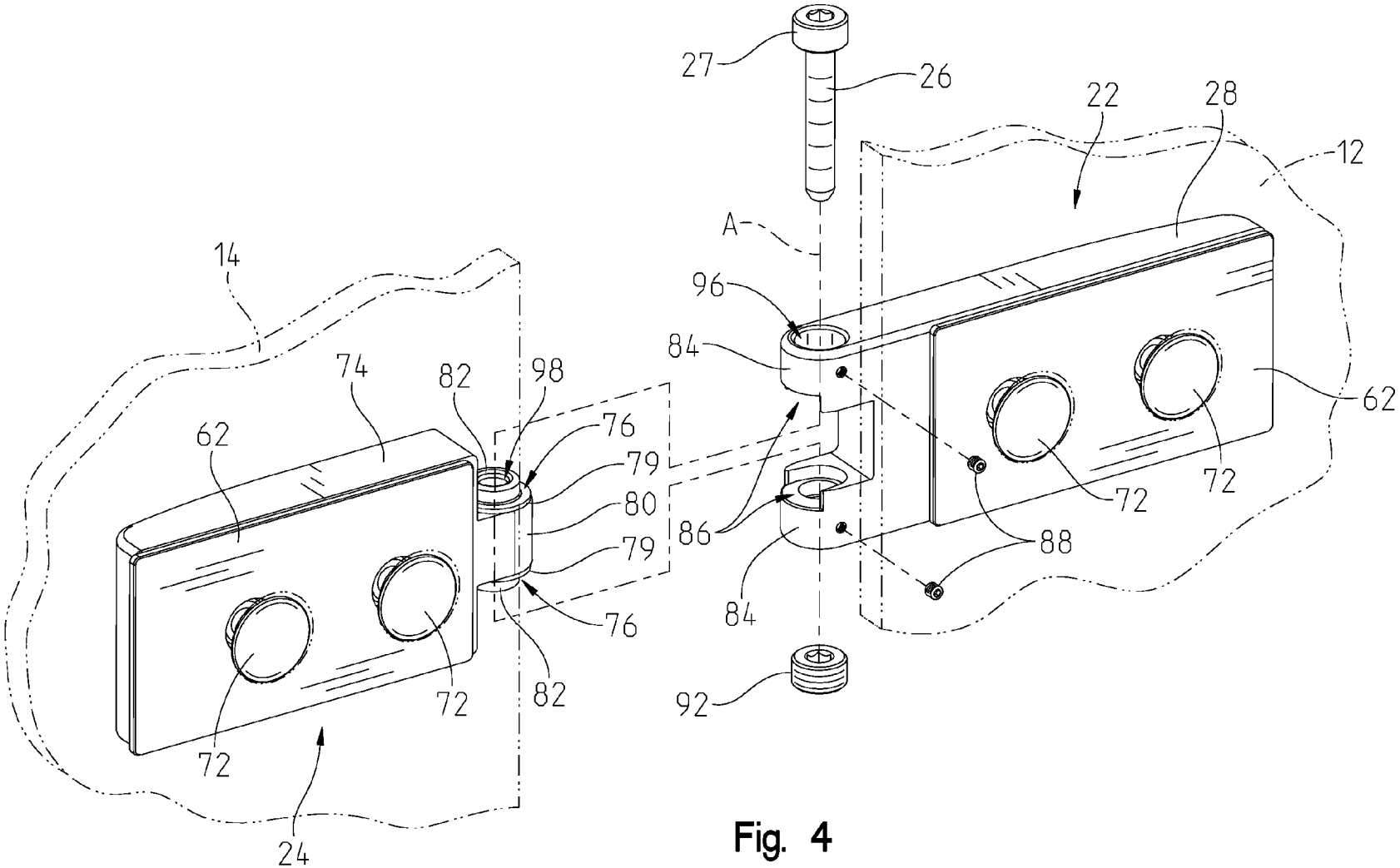
FIG. 4 is a perspective, partially exploded view of the hinge assembly shown in FIG. 2, taken from inside the shower enclosure of FIG. 1.

Upon arrival at the installation site, hinge panel 14 may be installed to its adjacent support surfaces in a conventional manner. Door 12 may then be installed to panel 14 by laterally advancing hinge nodes 84 over hinge node 80 as described in detail above. The tapered opening provided at channels 86, as shown in FIG. 4, may facilitate the alignment of bearing bosses 82 with channels 86. Once hinge nodes 80, 84 are substantially axially aligned, hinge pin 26 may be installed to fix door 12 to panel 14.

At this point, door 12 may be moved laterally and/or vertically using the adjustability provided by hinge assemblies 20, as described above. When a desired alignment between door 12 and panel 14 has been achieved, fasteners 70 are tightened to fix door 12 in the desired position.

Figure 8:
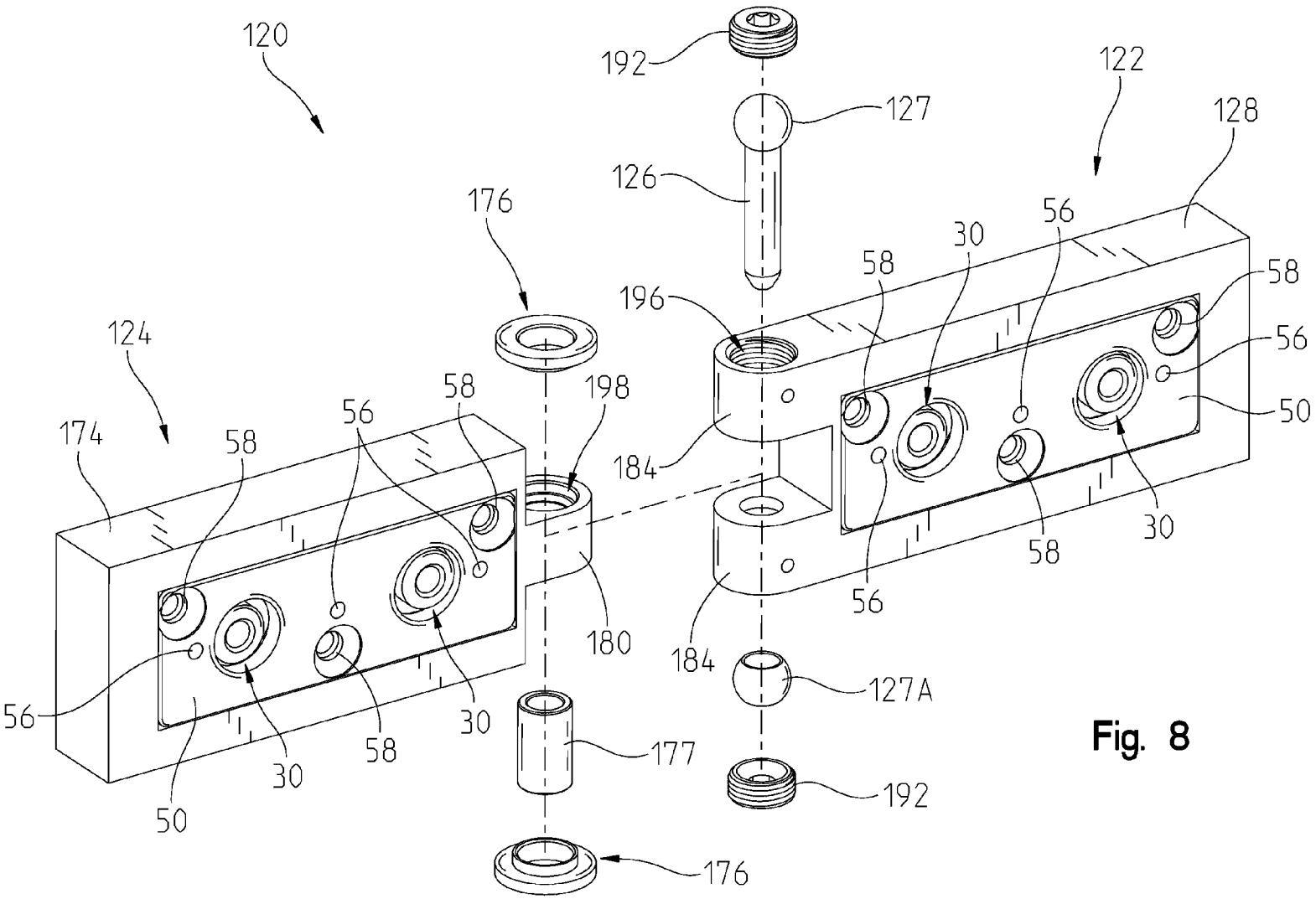
FIG. 8 is a perspective, exploded view of an alternative hinge assembly utilizing a spherical hinge pin arrangement for angular adjustability between the fixed and pivotable hinge halves.
Figure 9:
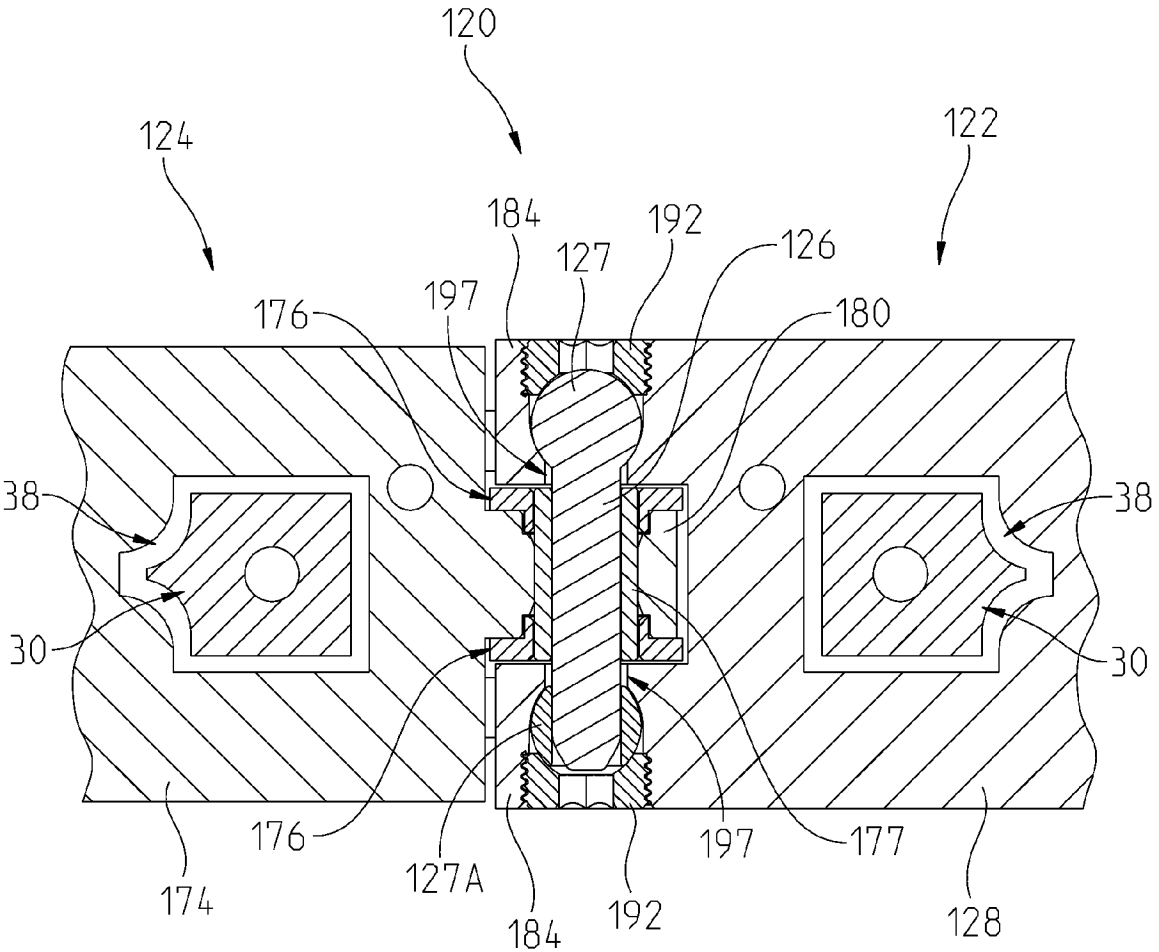
FIG. 9 is an elevation, cross-section view of the hinge assembly shown in FIG. 8.

Turning now to FIGS. 8 and 9, an alternative hinge embodiment is illustrated in which hinge assembly 120 provides angular adjustment between the longitudinal axes of hinge nodes 80 and 84. In particular, hinge assembly 120 is configured to allow the longitudinal axes of hinge halves 122 and 124 to be askew within a predetermined range of adjustability, thereby providing yet another mode of adjustment between door 12 and panel 14.

Hinge assembly 120 includes floating bushings 30 captured in bushing seats 38 by retainer plates 50, in the same manner as described in detail above with respect to hinge assembly 20. Moreover, hinge assembly 120 is similarly constructed to hinge assembly 20, and corresponding structures and features of hinge assembly 120 have corresponding reference numerals to hinge assembly 20, except with 100 added thereto.

However, hinge assembly 120 utilizes pivot pin 126 having a spherical head 127 as illustrated in FIG. 8. As best seen in FIG. 9, spherical head 127 is received within a correspondingly spherical seat within hinge bore 196 of pivotable hinge body 128. Pin cover 192 also includes a spherical seat for the top portion of spherical head 127, and is threadably received within hinge bore 196 to axially capture hinge pin 126 within bore 196. The cylindrical shaft of hinge pin 126 passes through hinge bearings 176 and hinge bearing sleeve 177, both of which are coupled to hinge node 180 in a similar fashion to bearings 76 and hinge node 80 as described above. Moreover, bearings 76 may also be used in connection with pin 126 as required or desired for a particular design, and bearing nodes 180 and 184 may be modified to include the tolerancing and assembly features described above with respect to nodes 80 and 84.

The distal end of hinge pin 126 receives a second bushing or spherical insert 127A having a shape and size similar to spherical head 127. A second pin cover 192 may be threaded into the second bearing node 184 as illustrated in FIGS. 8 and 9. At this point, hinge halves 122 and 124 are pivotably coupled to one another in a similar fashion to the pivotable coupling of hinge halves 22 and 24 described above. However, the spherical shape of pin head 127 and bushing 127A cooperate with their correspondingly spherical seats to allow the longitudinal axes of hinge node 80 and nodes 84 to be non-coaxial (i.e., askew), forming an angle relative to one another within predetermined limits.

In particular, FIG. 9 illustrates oversized cylindrical bores 197 which receive the cylindrical portion of hinge pin 126 with substantial clearance. In an exemplary embodiment, for example, the outer diameter of pin 126 may be smaller than the adjacent inner diameter of bore 197 to define a total clearance between 0.030 and 0.070 inches. In the illustrated embodiment, for example, this clearance is 0.050 inches (such that the gap between pin 126 and bore 197 is 0.025 inches on either side of pin 126 when centered). Hinge halves 122 and 124 may therefore be angled with respect to one another until the wall of one or both of hinge bores 197 impact the outer surface of hinge pin 126. In an exemplary embodiment, this angular adjustment may be up to 3 degrees, 5 degrees, or 7 degrees in either direction, for example.

Upon installation, each hinge assembly 120 may be adjusted angularly to accommodate the desired spatial arrangement between door 12 and the surrounding structures, including hinge panel 14, header 40, footer 42, and latch panel 16. When both hinge assemblies 120 (i.e., the upper and lower hinge assemblies) are fixed into place with respect to door 12 and hinge panel 14, the angular adjustment is also fixed.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A hinge assembly comprising:

a first hinge half fixable to a pivotable door and having a first hinge node;

a second hinge half fixable to a stationary panel and having a second hinge node pivotably connectable to the first hinge node by a hinge pin;

a recessed bushing seat formed in at least one of the first hinge half and the second hinge half, the bushing seat having a lateral extent and a vertical extent, and a recess extending parallel to the lateral extent; and a floating bushing received in the bushing seat and sized to allow both lateral travel and vertical travel of the floating bushing within the bushing seat, the floating bushing including a pointed protrusion extending parallel to the lateral extent of the recessed bushing seat and received within the recess of the bushing seat for limiting rotation of the floating bushing within the bushing seat to a predetermined range.

2. The hinge assembly of claim 1, wherein the recess of the bushing seat comprises a pair of surfaces tapering towards a point configured to engage a correspondingly tapered pair of surfaces defining the pointed protrusion on the floating bushing when the floating bushing reaches a first extreme end of the lateral travel.

3. The hinge assembly of claim 2, wherein the bushing seat comprises a rounded edge opposite the tapered pair of surfaces, the rounded edge configured to engage a correspondingly rounded edge of the floating bushing when the floating bushing reaches a second extreme end of the lateral travel opposite the first extreme end.

4. The hinge assembly of claim 3, wherein the total lateral travel between the first and second extreme ends of lateral travel cooperates with the respective tapered surfaces to limit the rotation of the floating bushing to the predetermined range.

5. The hinge assembly of claim 4, wherein the predetermined range is between 3 degrees and 7 degrees.

6. The hinge assembly of claim 1, further comprising a retainer plate fixed to a door-facing surface of at least one of the first hinge half and the second hinge half, the floating bushing being captured between the retainer plate and a body of the first hinge half or second hinge half, the retainer plate having a retainer-plate aperture aligned with a threaded aperture of the floating bushing throughout the lateral travel and the vertical travel of the floating bushing.

7. The hinge assembly of claim 6, further comprising a pressure plate mounted over the door-facing surface and the retainer plate, the pressure plate having a pressure-plate aperture aligned with the retainer-plate aperture.

8. The hinge assembly of claim 7, further comprising:

a panel adjacent the pressure plate and having at least one hinge-fixation aperture formed therethrough, the hinge-fixation aperture having a conical countersink;

a deformable bushing received in the hinge-fixation aperture, the deformable bushing having a first conical outer surface bearing against the conical countersink; and a rigid bushing which is made of a material having a higher elastic modulus than the deformable bushing, the rigid bushing having a second conical outer surface bearing against a correspondingly conical inner surface of the deformable bushing, a fastener received through the rigid bushing, the deformable bushing, and the panel and secured to the floating bushing.

9. The hinge assembly of claim 1, wherein at least one of the first hinge node and the second hinge node comprises a spherical seat, the assembly further comprising a hinge pin having a spherical pin head sized to be received in the spherical seat when the first hinge half and the second hinge half are pivotably connected to one another, such that a first longitudinal axis defined by the first hinge node can be angled away from a second longitudinal axis defined by the second hinge node by a predetermined amount.

10. A shower door assembly comprising:

a pivotable door;

a stationary panel;

a first hinge half fixed to the pivotable door and having a first pair of recessed bushing seats formed in a door-facing surface thereof;

a second hinge half fixable to the stationary panel and having a second pair of recessed bushing seats formed in a door-facing surface thereof; and a floating bushing received in each of the recessed bushing seats and respectively captured between the pivotable door and first hinge half and the stationary panel and the second hinge half, each floating bushing sized to allow both lateral travel and vertical travel of each floating bushing within each respective bushing seat, each floating bushing sized to limit rotation of each floating bushing within each respective bushing seat to a predetermined range;

wherein each floating bushing includes a threaded bore;

the pivotable door and the stationary panel each include a pair of hinge-fixation apertures larger than the threaded bore and aligned with the threaded bore when the first hinge half and the second hinge half are fixed to the pivotable door and the stationary panel respectively; and a panel mounting bolt is received through each hinge-fixation aperture and threaded into the threaded bore.

11. The shower door assembly of claim 10, further comprising:

a first retainer plate fixed to the door-facing surface of the first hinge half such that the floating bushings of the first hinge half are captured between the retainer plate and a body of the first hinge half, the first retainer plate having a first pair of retainer-plate apertures aligned with the pair of hinge-fixation apertures of the pivotable door; and a second retainer plate fixed to the door-facing surface of the second hinge half such that the floating bushings of the second hinge half are captured between the retainer plate and a body of the second hinge half, the second retainer plate having a second pair of retainer-plate apertures aligned with the pair of hinge-fixation apertures of the stationary panel.

12. The shower door assembly of claim 11, further comprising:

a first pressure plate disposed between the pivotable door and the first hinge half, the first pressure plate having a first pair of pressure-plate apertures aligned with the pair of hinge-fixation apertures of the pivotable door; and a second pressure plate disposed between the pivotable door and the first hinge half, the first pressure plate having a second pair of pressure-plate apertures aligned with the pair of hinge-fixation apertures of the stationary panel.

13. The shower door assembly of claim 12, further comprising:

a deformable bushing received in each of the hinge-fixation apertures, the deformable bushing having a first conical outer surface bearing against a correspondingly conical countersink formed in each of the hinge-fixation apertures; and a rigid bushing which is made of a material having a higher elastic modulus than the deformable bushing, the rigid bushing received between each deformable bushing and the adjacent panel mounting fastener, the rigid bushing having a second conical outer surface bearing against a correspondingly conical inner surface of the deformable bushing, whereby pressure is evenly distributed around respective hinge-fixation apertures.

14. The shower door assembly of claim 10, wherein the first hinge half includes a first hinge node and the second hinge half includes a second hinge node, and the first hinge node and the second hinge node cooperate to define a bore having a spherical seat, the assembly further comprising:

a hinge pin having a spherical pin head sized to be received in the spherical seat when the first hinge half and the second hinge half are pivotably connected to one another at the bore, such that a first longitudinal axis defined by the first hinge node can be angled away from a second longitudinal axis defined by the second hinge node by a predetermined amount.

15. A method of partially pre-assembling a shower enclosure comprising the hinge assembly of claim 1, the method comprising:

adjustably attaching the first hinge half to the pivotable door such that the first hinge half is moveable laterally and vertically, the first hinge node defining a first longitudinal axis; and adjustably attaching the second hinge half to the stationary panel such that the second hinge half is moveable laterally and vertically, the second hinge node defining a second longitudinal axis.

16. The method of claim 15 further comprising installing a hinge bearing to one of the first hinge half and the second hinge half, such that a hinge bearing axis defined by the hinge bearing is aligned with one of the first longitudinal axis and the second longitudinal axis.

17. The method of claim 16, further comprising:

laterally advancing the hinge bearing into a channel formed in the other of the first hinge half and the second hinge half, thereby aligning the hinge bearing axis with the other of the first longitudinal axis and the second longitudinal axis; and rotatably attaching the first hinge node to the second hinge node, such that the first longitudinal axis is substantially coincident with the second longitudinal axis.

18. The method of claim 17, wherein the step of rotatably attaching comprises passing the hinge pin through respective hinge bores formed through the first hinge node and the second hinge node.

19. The method of claim 15, further comprising:

rotatably attaching the first hinge node to the second hinge node by passing the hinge pin through respective hinge bores formed through the first hinge node and the second hinge node, the hinge pin comprising a spherical pin head sized to be received in a correspondingly spherical seat formed in one of the respective hinge bores; and angularly adjusting the first hinge half with respect to the second hinge half about the spherical seat such that the first longitudinal axis is askew from the second longitudinal axis within a predetermined range.

* * * * *